US007815086B2

(12) United States Patent
Kubo

(10) Patent No.: US 7,815,086 B2
(45) Date of Patent: Oct. 19, 2010

(54) NAILING MACHINE

(75) Inventor: Kouji Kubo, Tokyo (JP)

(73) Assignee: Max Co., Ltd., Tokyo (JP)

( * ) Notice: Subject to any disclaimer, the term of this patent is extended or adjusted under 35 U.S.C. 154(b) by 75 days.

(21) Appl. No.: 12/278,038

(22) PCT Filed: Feb. 2, 2007

(86) PCT No.: PCT/JP2007/051793

§ 371 (c)(1),
(2), (4) Date: Aug. 1, 2008

(87) PCT Pub. No.: WO2007/088968

PCT Pub. Date: Aug. 9, 2007

(65) Prior Publication Data

US 2009/0020582 A1 Jan. 22, 2009

(30) Foreign Application Priority Data

Feb. 3, 2006 (JP) ..... 2006-026668

(51) Int. Cl.
*B27F 7/17* (2006.01)

(52) U.S. Cl. ..... 227/8; 227/156; 227/109; 227/119; 227/139

(58) Field of Classification Search ..... 227/120, 227/107, 109, 119, 130, 139, 156, 8
See application file for complete search history.

(56) References Cited

U.S. PATENT DOCUMENTS 3,260,437 A * 7/1966 Parr ..... 227/149
3,826,419 A * 7/1974 Maestri ..... 227/136
4,018,254 A * 4/1977 DeCaro ..... 81/57.37
5,437,404 A * 8/1995 Shkolnikov ..... 227/109
5,452,835 A * 9/1995 Shkolnikov ..... 227/8
5,647,525 A * 7/1997 Ishizawa ..... 227/113
5,927,163 A * 7/1999 Habermehl et al. ..... 81/434
6,761,299 B2 * 7/2004 Caringella et al. ..... 227/10

(Continued)

FOREIGN PATENT DOCUMENTS

JP 55-111778 8/1980

(Continued)

*Primary Examiner*—Paul R Durand
(74) *Attorney, Agent, or Firm*—Drinker Biddle & Reath LLP

(57) ABSTRACT

A nailing machine is provided with a nailing machine body 1 in which a contact arm 16 is arranged so as to slide along a nose portion 10, and a plurality of contact noses 2(3) having different inside diameters. The contact noses 2(3) can be mounted to and dismounted from a lower end of the contact arm 16, and nails having different diameters can be used by exchanging the contact noses 2(3). The inside diameter of the nose portion 10 is so formed as to fit to a large nail 21 having the largest head diameter among the nails to be used. A diameter of a driver 5 is so formed as to fit to the contact nose 2(3) for a small nail 22 having the smallest head diameter. A conical pipe portion 25 which is upwardly enlarged in diameter for guiding a nail tip is formed in an upper part of the contact nose 2(3). An upper end of this conical pipe portion 25 is so formed as to have a larger diameter than that of the nose portion 10.

5 Claims, 4 Drawing Sheets

U.S. PATENT DOCUMENTS

| | | | | |
|---|---|---|---|---|
| 6,808,101 | B2 * | 10/2004 | Laubach et al. | 227/109 |
| 7,628,304 | B2 * | 12/2009 | Yamamoto et al. | 227/8 |
| 2002/0185515 | A1 * | 12/2002 | Kubo et al. | 227/8 |
| 2004/0068270 | A1 * | 4/2004 | Allred, III | 606/107 |
| 2009/0256122 | A1 * | 10/2009 | Giltner et al. | 254/18 |

FOREIGN PATENT DOCUMENTS

| | | |
|---|---|---|
| JP | 2-51079 | 4/1990 |
| JP | 2004-330366 | 11/2004 |
| JP | 2005-161496 | 6/2005 |

* cited by examiner

NAILING MACHINE

TECHNICAL FIELD

The present invention relates to a nailing machine, and more particularly, to the nailing machine including a body which is provided with a nose portion for slidably guiding a driver, in a lower part of a housing, and a contact arm which is arranged so as to slide along this nose portion, and a plurality of contact noses having different inside diameters.

BACKGROUND ART

Generally, the nailing machine is so constructed that an actuating trigger valve can be operated by two operations, firstly, pulling a trigger lever which is provided so as to actuate the machine, and secondly, pushing a contact arm which is provided so as to slide along a nose portion for injecting a nail into a member to be nailed, thereby to actuate a striking mechanism.

Although the contact arm constitutes a safety device of the nailing machine in this manner, there has been known a type of the nailing machine in which a contact nose is coupled to a distal end of the contact arm, instead of using the contact arm as a single body, and a nail is driven from an injection port inside the contact nose. Because the contact nose is so constructed as to be integrally coupled to the contact arm, it is possible to dismount the contact nose from the nose portion by removing it from the distal end of the contact arm, and it becomes possible to use a plurality of the contact noses which are different in a shape of a distal end and an inside diameter of the injection port thereof, by exchanging them. Accordingly, it becomes possible to use the nails having different head diameters in a single nailing machine, by selectively mounting a plurality of the contact noses formed with the injection ports whose inside diameters are different from each other according to a head diameter of the nail to be used in the nailing machine (Reference should be made to JP-A-2005-161496).

However, because the inside diameter of the nose portion is formed so as to fit to the head diameter of a large nail among the nails to be used, the inside diameter of the contact nose too must be inevitably large. For this reason, in case where a small nail having a smaller diameter than a standard head diameter is used, this small nail is seriously inclined inside the injection port of the contact nose, and cannot be maintained in a favorable posture. Therefore, there is such anxiety that this small nail may be collapsed when it is struck. In fact, it has been difficult to drive the nail which is smaller than the standard nail, although it has been possible to drive the nail having the large head diameter and the nail having the standard head diameter.

Moreover, since a diameter of a driver is larger than the head diameter of the standard nail, a driving trace of the driver is formed on a surface of the member to be nailed, when this nail is driven into the member, and favorable finishing performance is unable to be secured.

DISCLOSURE OF THE INVENTION

In one or more embodiments of the invention, there is provided a nailing machine which can reliably drive a nail without causing a driving trace, even though the nail has a large head diameter or a standard head diameter, and further it has a smaller head diameter than the standard head diameter.

In a first aspect of the invention, there is provided a nailing machine comprising a nailing machine body including a nose portion for slidably guiding a driver which is formed in a lower part of a housing, and a contact arm whose upper end is arranged close to an actuating trigger lever and which is provided so as to slide along the nose portion, a plurality of contact noses having different inside diameters corresponding to head diameters of nails to be used, each of the contact noses being provided below the nose portion so as to move in an axial direction of the nose portion, wherein the contact noses can be mounted to and dismounted from a lower end of the contact arm, and the nails having different head diameters can be used by exchanging the contact noses, characterized in that the inside diameter of the nose portion is so formed as to fit to a large nail having the largest head diameter among the nails to be used, and at the same time, a diameter of the driver is so formed as to fit to the contact nose for a small nail having the smallest head diameter, and further, a conical pipe portion which is upwardly enlarged in diameter is formed in an upper part of the contact nose, an upper end of this conical pipe portion being so formed as to have a larger diameter than the inside diameter of the nose portion.

In a second aspect of the invention, a straight portion may be formed in a lower part of the contact nose.

According to the nailing machine in the first aspect, it is possible to drive the nails of wide variety, by selecting and coupling the contact nose having the different inside diameters to the contact arm. As for the small nail or the nail having the small head diameter, it is possible to enhance the finishing performance with the contact nose having the smaller inside diameter.

Moreover, because there is formed the conical pipe portion for guiding the nail tip of the nail which has been driven out from the nose portion, it is possible to reliably receive the nail into the contact nose, even though the nail is inclined, and to drive it into the member to be nailed without being collapsed.

Further, because the diameter of the driver is so formed as to fit to the contact nose for the nail having the smallest head diameter, driving traces of the driver will not be formed on the surface of the member to be nailed, even when the nail having the smallest head diameter is driven, and hence, the finishing performance is enhanced.

Moreover, according to the nailing machine in the second aspect, because the straight portion is formed in the lower part of the contact nose, inclination of the nail inside the contact nose is so small. Therefore, it is possible for the driver to reliably strike the head of the nail.

Other aspects and advantages of the invention will be apparent from the following description, the drawings and the claims.

DESCRIPTION OF THE REFERENCE NUMERALS AND SIGNS

Figure 1:
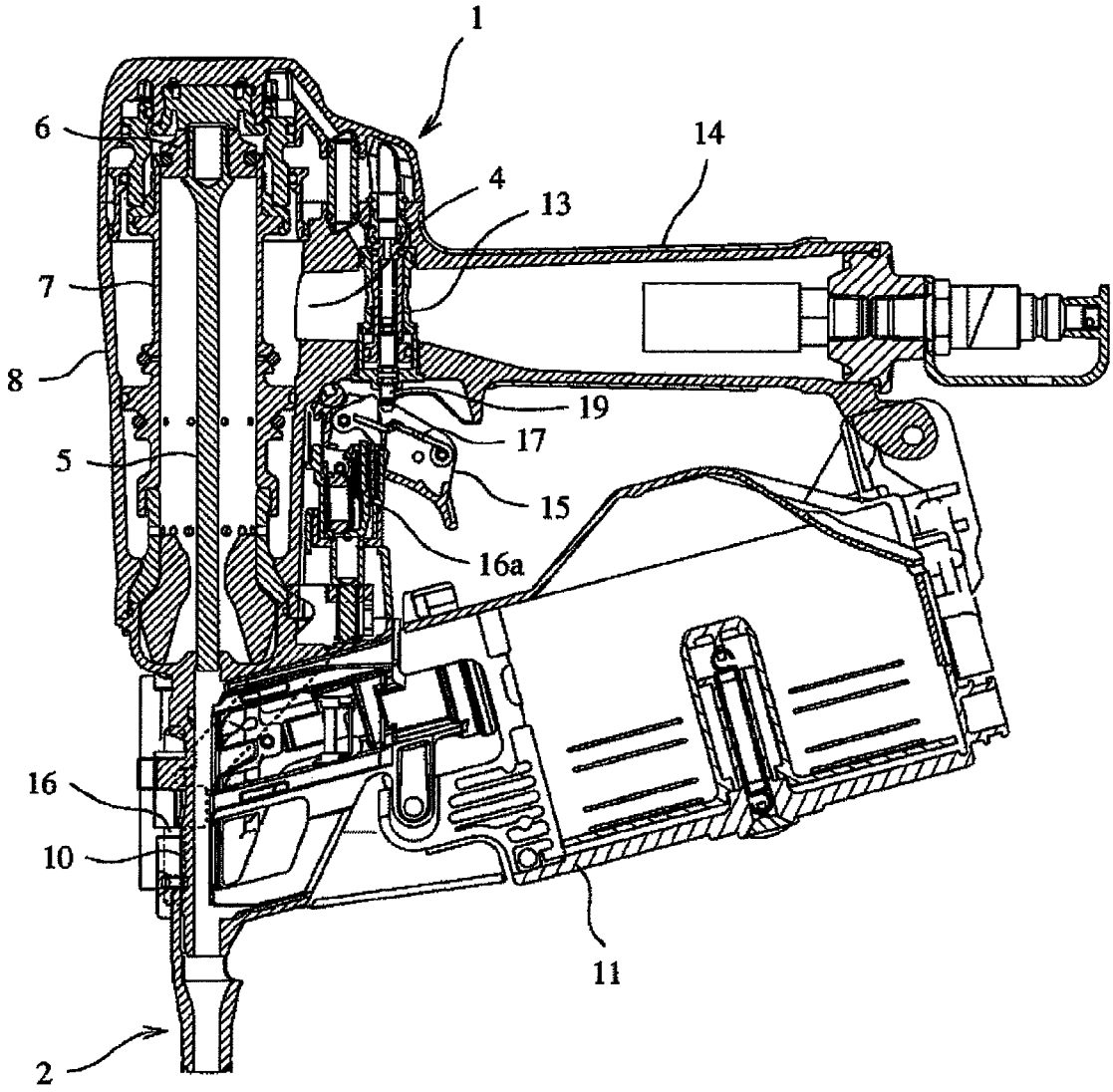
FIG. 1 is a longitudinal sectional view of a nailing machine in an exemplary embodiment of the invention in a state where a contact nose for a large nail is coupled to a nailing machine body.

1 Nailing machine body
2, 3 Contact nose
10 Nose portion
15 Trigger lever
16 Contact arm
25 Conical pipe portion

BEST MODE FOR CARRYING OUT THE INVENTION

Figure 2:
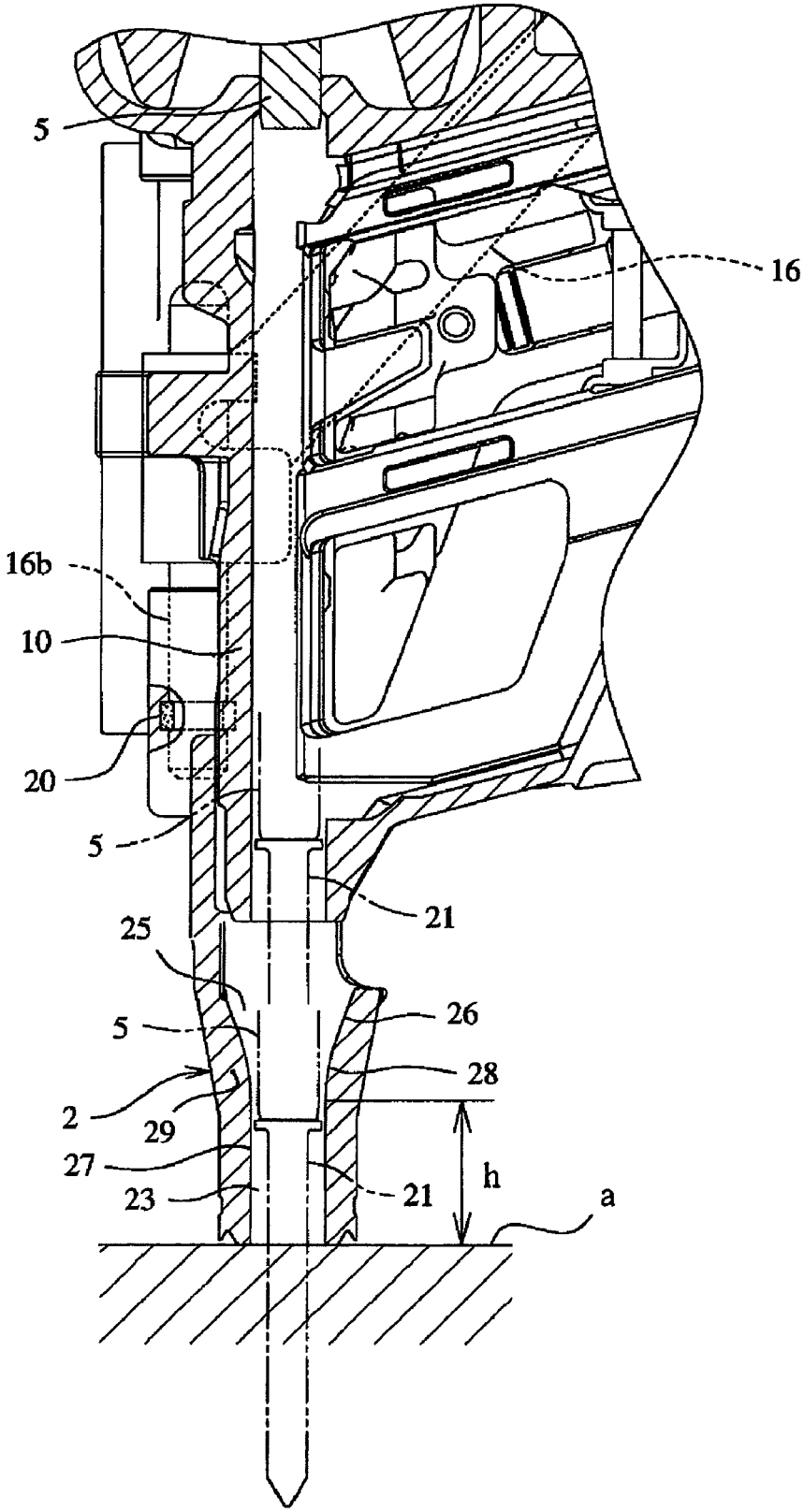
FIG. 2 is an enlarged sectional view of an essential part of FIG. 1.
Figure 3:
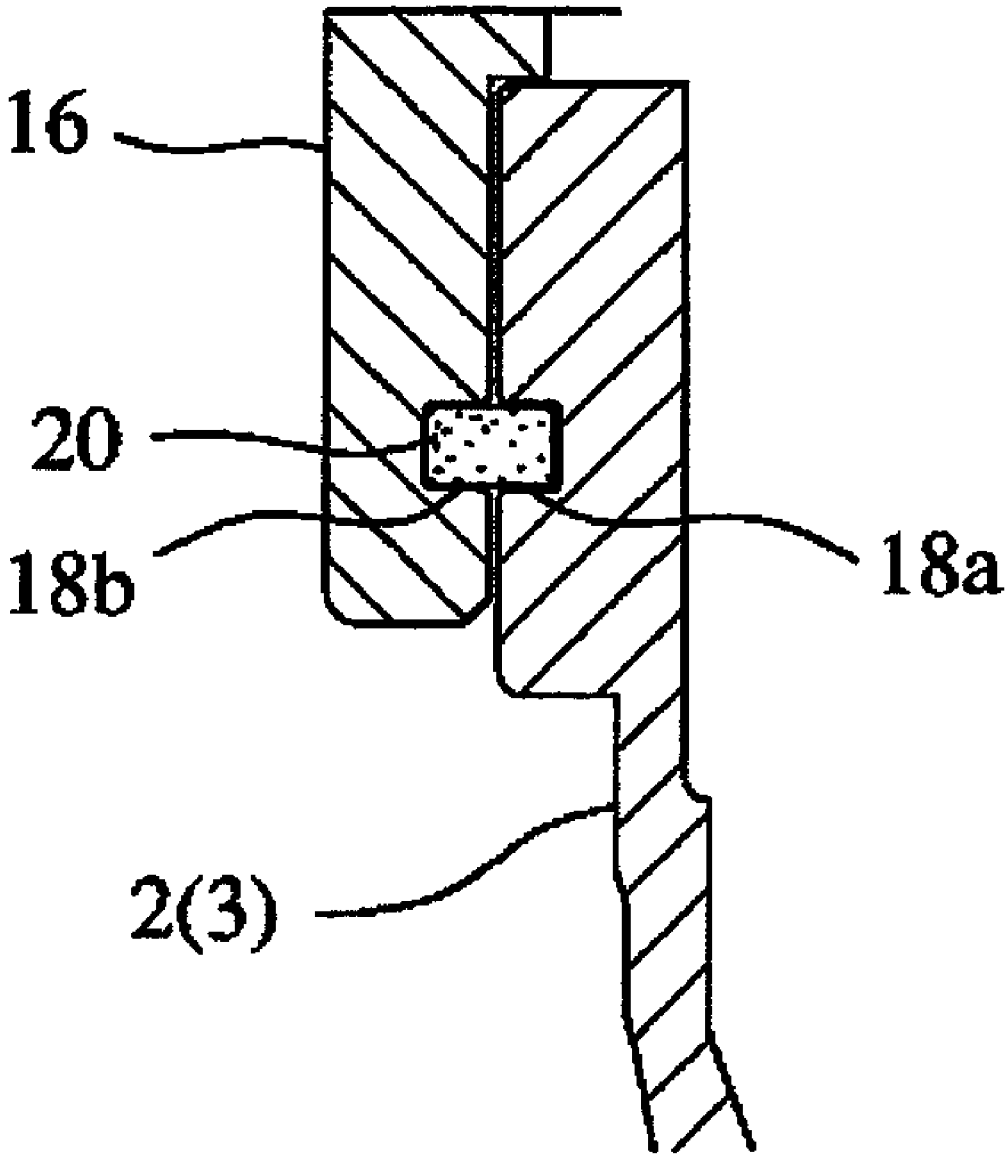
FIG. 3 is an enlarged sectional view showing a manner of coupling the contact nose to a contact arm.
Figure 4:
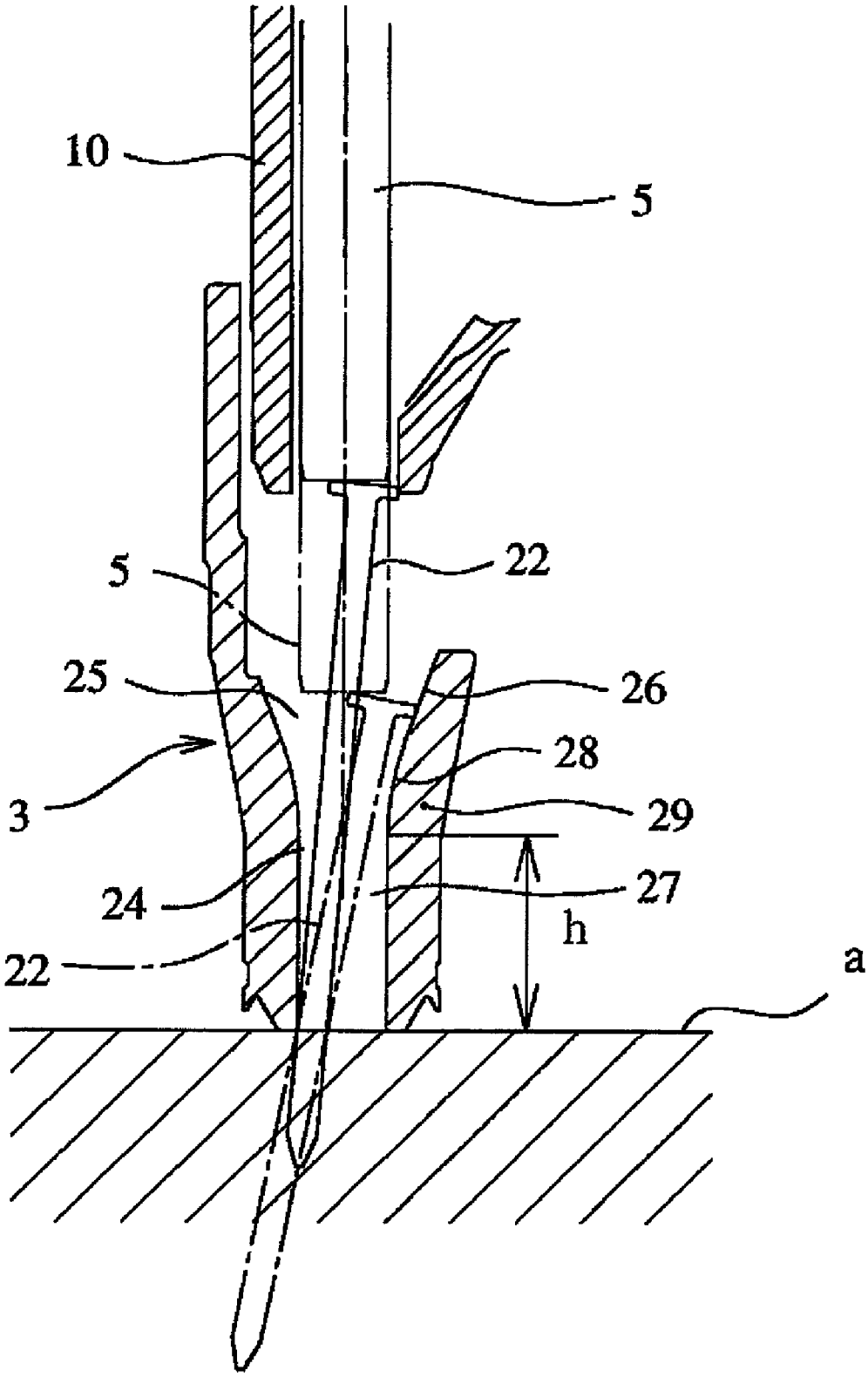
FIG. 4 is an enlarged sectional view in a state where a contact nose for a small nail is coupled to a nailing machine body.

An exemplary embodiment of the invention will be described referring to the drawings. FIG. 1 is a longitudinal sectional view of a nailing machine, FIG. 2 is an enlarged sectional view of an essential part of FIG. 1, FIG. 3 is an enlarged sectional view showing a manner of coupling a contact nose to a contact arm, and FIG. 4 is an enlarged sectional view in a state where a contact nose for a small nail is coupled to a nailing machine body. The aforesaid nailing machine includes a nailing machine body 1, a plurality of a contact nose 2 (See FIGS. 1 and 2) and a contact nose 3 (See FIG. 4) having different inside diameters, and so on.

In the nailing machine body 1, there is provided a striking mechanism including a striking piston 6 which is integrally formed with a driver 5 for striking a nail utilizing a compressed air stored in an air chamber 4, and a striking cylinder 7 which contains therein the striking piston 6 so as to slide. A nose portion 10 is provided below a housing 8 which contains the striking mechanism. A backward end of the nose portion 10 is continued to a magazine 11 by way of an open part. Nails inside the magazine 11 are adapted to be forwarded one by one to an inside of the nose portion 10 by a nail supplying mechanism (not shown).

Moreover, in the housing 8, there is provided a trigger valve 13 for actuating the nailing machine by driving the striking mechanism in such a manner that the striking piston 6 is moved by introducing the compressed air in the air chamber 4 into the striking cylinder 7. This trigger valve 13 is so constructed as to actuate the nailing machine by driving the striking mechanism by two operations, namely, pulling a trigger lever 15 which is arranged below a grip part 14, and pressing the contact nose 2, 3 coupled to a below described contact arm 16 against a surface of a work "a" to be nailed, whereby the compressed air is introduced into the striking cylinder 7 to drive the striking piston 6.

The contact arm 16 is provided so as to slide along the nose portion 10, and its upper end 16*a* is arranged below a contact lever 17 of the trigger lever 15.

The contact nose 2 (3) is provided below the nose portion 10 so as to be mounted to and dismounted from a lower end 16*b* of the contact arm 16. When a lower end of the contact nose 2 (3) is pressed against the surface of the work "a" to be nailed, the contact art 16 moves upward in the housing 8 and pushes the aforesaid contact lever 17 upward. Then, by further pulling the trigger lever 15 upward, the contact lever pushes in a valve stem 19 of the trigger valve 13 thereby to actuate the trigger valve 13, and thus, the striking mechanism can be driven.

By the way, the aforesaid nailing machine is provided with a plurality of the contact noses 2 (3) having different inside diameters, and so constructed that the nails having different head diameters can be used by exchanging the contact noses 2 (3).

Specifically, the contact noses 2 (3) are provided so as to be mounted and dismounted with respect to the contact arm 16. As shown in FIGS. 2 and 3, a recessed part 18*a* (a first recessed part 18*a*) for coupling is formed in an upper part of the contact nose 2 (3), and a recessed part 18*b* (a second recessed part 18*b*) for coupling is formed in a lower part of the contact arm 16. By pushing the first recessed part 18*a* of the contact nose 2(3) into an elastic body 20, which is fitted in the second recessed part 18*b*, to be engaged therewith, the contact nose 2(3) is coupled to and held by the contact arm 16 by way of the elastic body 20. In this manner, the contact noses 2 (3) can be exchanged without using a tool, because the contact nose is assembled to the contact arm 16 utilizing the elastic body 20.

By the way, an inside diameter of an injection port 23 of the contact nose 2 for a large nail 21 which is shown in FIG. 2 is formed so as to fit to a head diameter of the large nail 21, while an inside diameter of an injection port 24 of the contact nose 3 for a small nail 22 which is shown in FIG. 4 is formed so as to fit to a head diameter of the large nail 22. In this manner, there are a plurality of the contact noses in which the inside diameters of the injection ports vary from a large diameter to a small diameter according to sizes of the nails having different head diameters. However, in this embodiment, the contact nose 2 whose inside diameter is suitable for driving the large nail 21 having the largest head diameter (See FIGS. 1 and 2) among the nails to be used, and the contact nose 3 whose inside diameter is suitable for driving the small nail 22 having the smallest head diameter (See FIG. 4) will be described for convenience's sake, omitting the contact nose whose inside diameter is suitable for driving a medium-sized nail.

A conical pipe portion 25 which is upwardly enlarged in diameter for guiding a nail tip is formed above the injection ports 23, 24 of the contact noses 2, 3 so that the nail which has been driven out by the striking mechanism may be received even though it is inclined while moving from the nose portion 10 to the contact nose 2(3). An upper end of this conical pipe portion 25 has a larger inside diameter than the inside diameter of the nose portion 10. In case of the contact nose 3 for the small nail 22 as shown in FIG. 4, the conical pipe portion 25 is adapted to guide the nail tip so as to be received in the conical pipe portion 25, even though the nail 22 is in a state somewhat driven into the work "a" to be nailed, or a lower end of a small and short nail having a small head diameter is in contact with the surface of the work "a" to be nailed, and thus, the driver 5 can reliably strike the head of the nail.

Moreover, the contact nose 2 (3) is provided with a straight portion 27 which is formed below a taper face 26 inside the conical pipe portion 25. The taper face 26 and the straight portion 27 are continued by way of an R face 28. Because the inside diameter of the nose portion 10 is so set as to fit to the large nail 21 having the largest head diameter, inclination of the small nail 22 occurs during the driving operation. For this reason, it is desirable to secure a length "h" of the straight portion from the tip end, so that the driver 5 can strike the nail head even though the nail is inclined inside the contact nose 2 (3). The aforesaid straight portion 27 may be set to such an extent that the head of the nail 22 (21) is engaged with the conical pipe portion 25 in a state where the distal end of the contact nose 2 (3) is pressed against the surface of the work "a" to be nailed, and the lower end of the driver 5 can strike more than a half of the head of the nail 22 (21), when a stem portion of the nail 22 (21) is engaged with an inside of a lower end of the straight portion 27.

Further, in case of the long nail 22 having a small head diameter, during the driving process of the nail, the nail is guided along an inside of a lower end of the nose portion 10 and along an inside of a lower end of the contact nose 3, whereby the driver 5 can reliably strike more than a half of the nail head.

Still further, it is desirable to secure a wall thickness of a lower part 29 of the taper part in terms of strength so that the contact nose 2 (3) may not be broken, when the nail having the largest head diameter is used, by mistake, in the contact nose 3 having a small inside diameter, or when the nails are jammed due to a feeding trouble.

Still further, the distal end of the contact nose 2 (3) may have a shape of spike teeth, or a shape to be matched for a floor or a corrugated shape of a galvanize, so that driving operation suitable for the use can be performed.

On the other hand, the inside diameter of the nose portion 10 of the nailing machine body 1 is so formed as to fit to the largest head diameter of the large nail 21. Moreover, the diameter of the driver 5 is so formed as to fit to the inside diameter of the contact nose 2 (3) for the smallest head diameter of the small nail 22.

As described above, although the inside diameter of the nose portion 10 is so set as to fit to the largest head diameter, and the inside diameter of the contact nose 3 for the small nail 22 having the smallest head diameter is smaller than that of the nose portion 10, the driver 5 can slide inside the contact nose 3, because the diameter of the driver 5 is so formed as to fit to the contact nose 3 for the small nail 22. Therefore, even though the inside diameter of the contact nose 3 is smaller than the inside diameter of the nose portion 10, it is possible to drive out the nail.

Now, mode for using the nailing machine having the above described structure will be described. Firstly, in case where the large nail 21 has to be nailed, the contact nose 2 for the large nail 21 as shown in FIGS. 1 and 2 is coupled to the lower end of the contact arm 16 of the nailing machine body 1. In this case, both the inside diameter of the nose portion 10 and the inside diameter of the contact nose 2 are so formed as to fit to the largest head diameter of the large nail 21. The diameter of the driver 5 is so formed as to fit to the contact nose 3 for the smallest head diameter of the small nail 22. Therefore, the driver 5 can reliably strike the large nail 21 thereby to drive it into the member to be nailed.

Then, in case where the small nail 22 has to be driven by the aforesaid nailing machine, the contact nose 3 for the small nail 22 as shown in FIG. 4 is coupled to the lower end of the contact arm 16 of the nailing machine body 1. In this case, although the inside diameter of the contact nose 3 is smaller than the inside diameter of the nose portion 10, the contact nose 3 is provided with the conical pipe portion 25 in the upper part of the injection port 24, and an upper end of the conical pipe portion 25 is so formed as to have the larger diameter than the inside diameter of the nose portion 10. The conical pipe portion 25 guides the small nail 22 so that the nail tip can be received into the contact nose 2 (3), and therefore, the nail can be reliably struck without being collapsed, even though inclined, thereby to be driven into the work "a" to be nailed.

Further, because the diameter of the driver 5 is so formed as to fit to the contact nose 3 for the nail having the smallest head diameter, driving traces of the driver 5 will not be formed on the surface of the work "a" to be nailed, even when the nail having the smallest head diameter is driven, and hence, the finishing performance is enhanced.

Further, because the straight portion 27 is formed in the lower part of the contact nose 2 (3), inclination of the nail in the contact nose 2 (3) is small, and therefore, it is possible for the driver 5 to reliably strike the head of the nail.

Still further, it is possible to change color or letter of the contact nose 2 (3) according to the size thereof, so that a user can easily identify the contact nose 2 (3) which is now in use.

As described above, according to the above described nailing machine, it is possible to drive the nails of wide variety by selecting and coupling the contact nose having the different inside diameters to the contact arm. By coupling the contact nose having the larger inside diameter as for the large nail, and by coupling the contact nose having the smaller inside diameter as for the small nail or the nail having the small head diameter, it is possible to reliably drive the nails thereby to enhance the finishing performance.

Although the invention has been fully described referring to the specified embodiment, it is apparent to those skilled in the art that various changes and modifications may be made without departing from sprit and scope of the invention.

This application is based on Japanese Patent Application (Japanese Patent Application No. 2006-026668) which was filed on Feb. 3, 2006, the contents of which are hereby incorporated by reference.

INDUSTRIAL APPLICABILITY

This invention can be applied to a nailing machine, and more particularly, to the nailing machine including a nailing machine body which is provided with a nose portion for slidably guiding a driver, in a lower part of a housing, and a contact arm which is arranged so as to slide along this nose portion, and a plurality of contact noses having different inside diameters.

The invention claimed is:

1. A nailing machine comprising:

a nose portion configured to slidably guide a driver, a contact arm that is slidable along the nose portion, and a contact nose arranged at a lower end of the contact arm and mounted to and dismounted from the lower end of the contact arm, wherein an inside diameter of the nose portion is formed to fit to a large nail having the largest head diameter among the nails, wherein a diameter of the driver is formed to fit to the contact nose for a small nail having the smallest head diameter among the nails, wherein the contact nose includes, in an upper part thereof, a conical pipe portion which is upwardly enlarged in diameter for guiding a nail tip, and an upper end of the conical pipe portion has a larger diameter than that of the nose portion, wherein an upper portion of the contact nose is disposed on an outer side of a lower portion of the nose portion in a cross section perpendicular to a sliding direction of the driver, wherein a first recessed part is formed in an upper part of the contact nose, wherein a second recessed part is formed in a lower part of the contact arm, and wherein an elastic body is fitted between the first recessed part and the second recessed part, and the contact nose is coupled to the contact arm by way of the elastic body to be held.

2. The nailing machine according to claim 1, wherein an upper end of the contact arm is arranged close to an actuating trigger lever, and nails having different diameters can be used by exchanging the contact noses so as to correspond to a head diameter of the nail to be used.

3. The nailing machine according to claim 1, wherein the contact nose includes a straight portion in a lower part thereof.

4. The nailing machine according to claim 3, wherein the conical pipe portion has a taper face inside thereof, and the taper face is continued to the straight portion by way of an R face.

5. The nailing machine according to claim 1, further comprising:

a striking mechanism including a striking piston which is integrally formed with the driver for striking nails utilizing compressed air stored in an air chamber.

* * * * *